US007673352B2

(12) United States Patent
Li

(10) Patent No.: US 7,673,352 B2
(45) Date of Patent: Mar. 9, 2010

(54) FLUSH VALVE FOR WATER CLOSETS

(76) Inventor: Feiyu Li, First Floor, #43 Huli Main Road, Xiamen 361006 (CN)

( * ) Notice: Subject to any disclaimer, the term of this patent is extended or adjusted under 35 U.S.C. 154(b) by 817 days.

(21) Appl. No.: 11/429,495

(22) Filed: May 5, 2006

(65) Prior Publication Data

US 2006/0253966 A1 Nov. 16, 2006

Related U.S. Application Data

(60) Provisional application No. 60/679,535, filed on May 10, 2005.

(51) Int. Cl.
*E03D 1/34* (2006.01)

(52) U.S. Cl. ..... 4/390; 4/325

(58) Field of Classification Search ..... 4/390, 4/367, 391, 383, 378; 137/436; 251/38, 251/22

See application file for complete search history.

(56) References Cited

U.S. PATENT DOCUMENTS

| | | | | |
|---|---|---|---|---|
| 363,166 | A * | 5/1887 | Platt | 4/382 |
| 4,115,882 | A | 9/1978 | Paulus | |
| 4,275,471 | A | 6/1981 | Becker | |
| 4,304,015 | A | 12/1981 | Hubatka | |
| 4,557,000 | A * | 12/1985 | Strangfeld | 4/324 |
| 6,728,975 | B2 | 5/2004 | Han | |
| 6,901,610 | B1 * | 6/2005 | Jensen et al. | 4/378 |
| 2004/0073993 | A1 * | 4/2004 | Frost | 4/378 |

* cited by examiner

*Primary Examiner*—Gregory L Huson
*Assistant Examiner*—Karen Younkins
(74) *Attorney, Agent, or Firm*—Walter A. Hackler

(57) ABSTRACT

A flush mechanism for a water closet include a housing fixable to a toilet flush tank outlet and a float body removable within the housing for controlling water discharge through the tank outlet. A hydraulic assist valve is disposed within the float body and moveable therein for causing upward opening movement of the float body in order to reduce exterior operational force required to operate the float body.

8 Claims, 2 Drawing Sheets

FIG. 2.
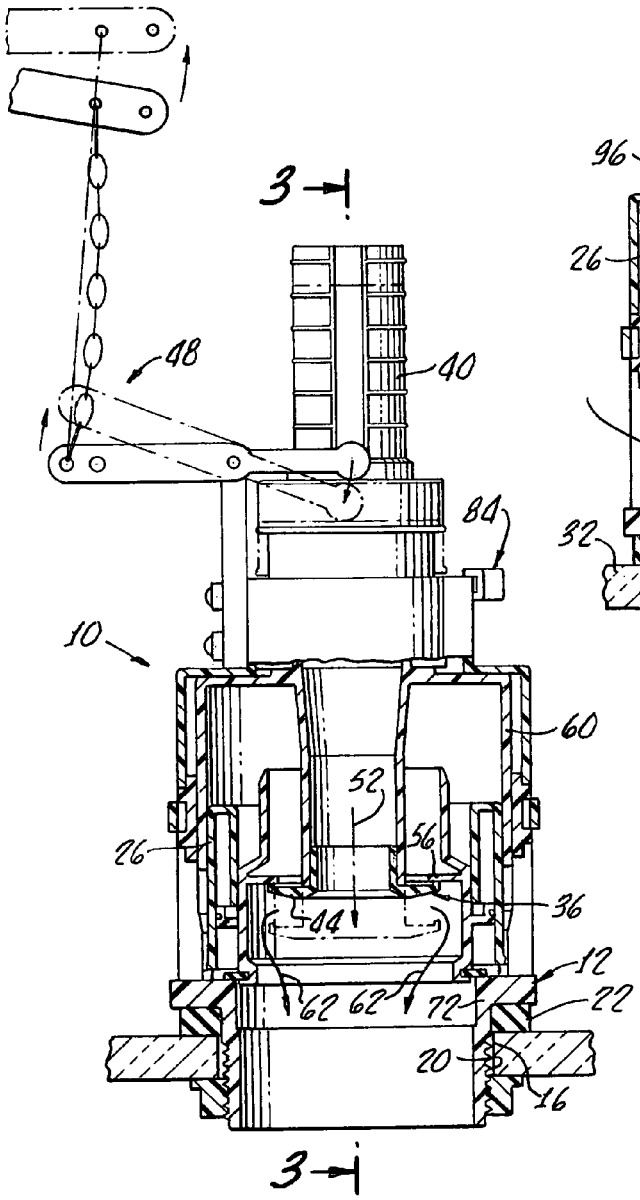
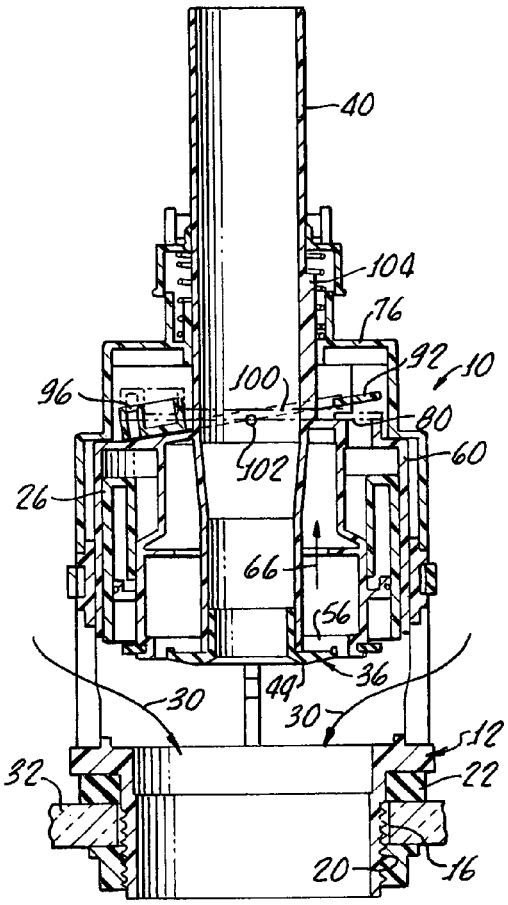
FIG. 3.

FLUSH VALVE FOR WATER CLOSETS

The present application claims priority from U.S. Provisional Patent Application Ser. No. 60/679,535 filed May 10, 2005. This application is to be incorporated herewith in its entirety into the present application.

The present invention is generally related to flush mechanisms for water closets and is more specifically directed to flush mechanisms with reduced requirements for operational force.

At present, water resources have dictated the use of efficient toilets/water closets. In that regard, to improve flush efficiency and save water, many toilet designs have raised tank water levels and/or increased outlet or discharge diameter.

Unfortunately, these improvements increase the pressure of the seal, which not only diminishes the valve durability, but also requires much greater manual force for operation. This increased force is an inconvenience and often difficult to overcome.

The flush mechanism in accordance with the present invention provides for the use of large outlet diameter valves while reducing the force required to operate such valves.

SUMMARY OF THE INVENTION

The present invention provides for a flush mechanism for a water closet with the mechanism including a housing fixable to a toilet flush tank outlet along with a float body, moveable within the housing, for controlling water discharge through the tank outlet. Tank outlet diameter of 3-4 inches or more are contemplated and feasible as the result of the flush mechanism in accordance with the present invention.

More particularly, valve means are provided which are disposed in the float body for hydraulically assisting upward movement of the float which thereby reduces exterior operational force required to operate the float body.

In other words, the present invention provides for a hydraulic assist valve which is disposed in the float body and moveable therewith for causing upward opening movement of the float body in order to reduce exterior operational force.

Still more particularly, the valve means in accordance with the present invention includes an upper flush valve chamber and a moveable seat releasably engaging a float seal for releasing water from the upper flush valve chamber into the tank outlet. Upon such release, the upper flush valve chamber seat and the seal rise with the float body in order to discharge a water through the tank outlet.

A flow control chamber is provided and is in fluid communication with the upper flush valve chamber through a least one hole. In addition a cover for sealing a hole is provided which is connected to a buoyant counterweight.

A slide mechanism is provided for controlling water flow through the hole into the upper flush chamber in order to control downward movement of the float body and stop the discharge of water through the tank outlet.

In addition, a spring may be provided for both biasing the seat against the float seal and also assisting upward movement of the upper flush valve chamber and float body.

More particularly, the seat may be formed at an end of a moveable overflow tube and downward movement of the tube separates the seat from the float seal. In addition, the buoyant counterweight and cover are disposed in the flow control chamber with the counterweight connected to the cover for opening the cover over the hole when the counterweight is in a downward position and closing the cover when a counterweight is in an upward position. In operation, the counterweight moves to the downward position upon loss of buoyancy.

The hereinabove noted slide mechanism may include an adjustable door for controlling water flow into the control chamber.

BRIEF DESCRIPTION OF THE DRAWINGS

The advantages and features of the present invention will be better understood by the following description when considered in conjunction with the accompanying drawings, in which:

FIG. 2 is a cross sectional view of the flush mechanism shown in FIG. 1 illustrating a hydraulic assist valve disposed within the float body and moveable therein for providing means to cause upward movement of the float body in order to reduce exterior operational force, a closed valve being shown in bold line while an open valve being shown in broken line; and FIG. 3 is a cross sectional taken along the line 3-3 of FIG. 2 and illustrating hydraulically assisted water discharge through a tank outlet.

DETAILED DESCRIPTION

Figure 1:
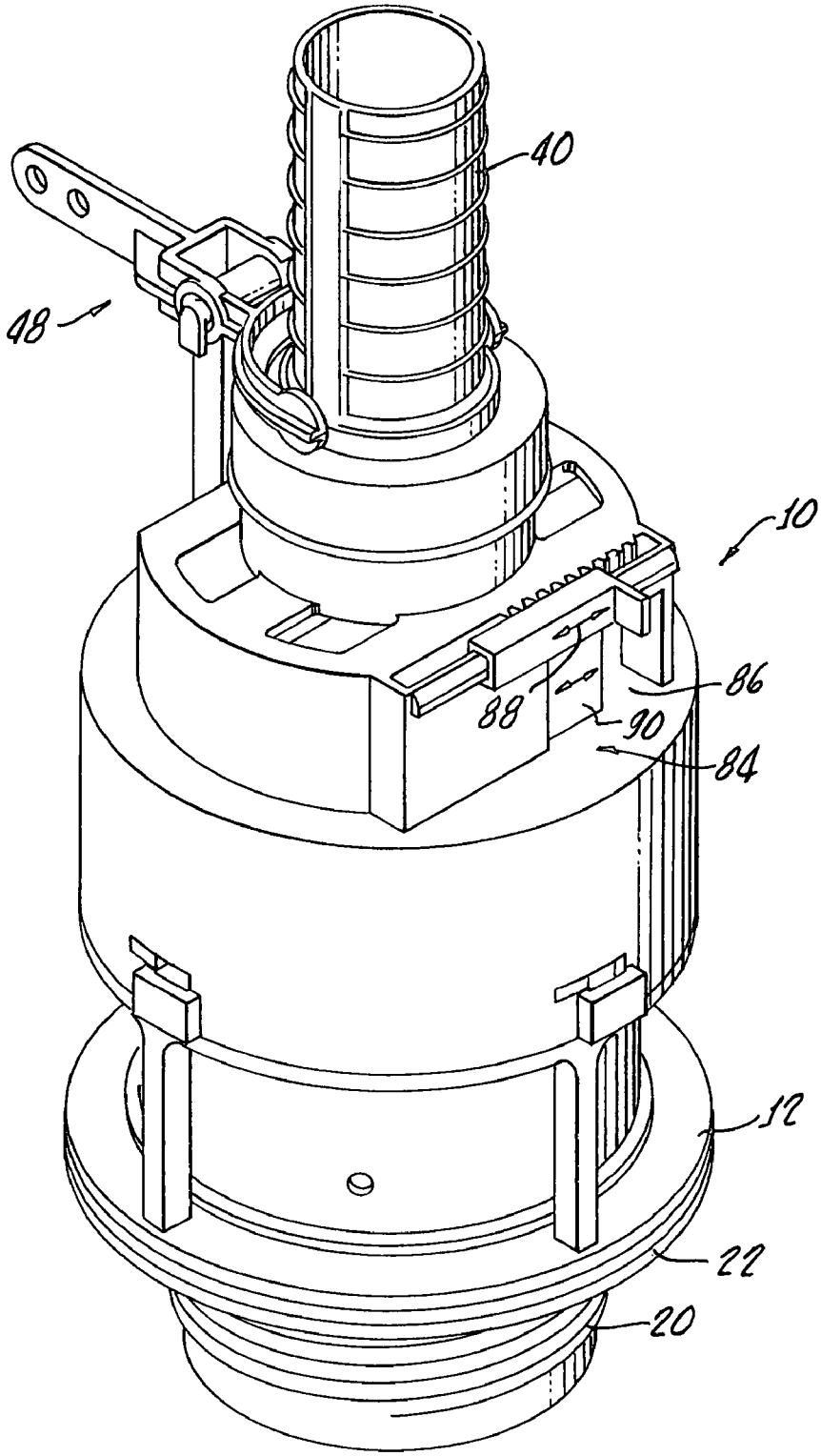
FIG. 1 is a perspective view of a flush mechanism in accordance with the present invention generally illustrating a housing fixable to a toilet flush tank outlet (not shown), a float body moveable within the housing, a moveable overflow tube along with a sliding mechanism for controlling water flow in order to control downward movement of the float body.

With reference to FIGS. 1-3, there is shown a flush mechanism 10 in accordance with the present invention which generally includes a housing 12 fixable to a toilet flush tank outlet 16 by way of threads 20 with a seal 22 therebetween.

A float body 26 moveable within the housing 12 is provided for controlling water discharge through the tank outlet 16, FIG. 2 showing a float body in a closed position and FIG. 3 showing the float body 26 in a raised, or open position enabling water discharge indicated by the arrows 30 from a water tank 32 through the outlet 16 as will be hereinafter described in greater detail.

A valve 36 disposed in the float body 26 provides a means for hydraulically assisting the upward movement of the float body 26 thereby reducing exterior operational force required to operated the float body.

The float body 26 may cover the flush tank outlet 16 which may have a diameter of three to four or more inches and accordingly depending upon the head of water in the tank require significant force to move. A large opening is required in modern water closets in order to provide momentum in an initial discharge water sufficient to provide efficient clearing of a toilet bowl, not shown.

Operation of the flush mechanism 10 is illustrated in FIGS. 2 and 3. Depression of an overflow tube 40 attached to an overflow seal seat 44 by a conventional lever mechanism 48 in the direction of the arrow 52 shown in FIG. 2 separates the seat 44 from an upper float seal 56, as illustrated in broken line in FIG. 2. This discharges water from an upper flush valve chamber 60 as indicated by arrows 62 through the flush tank outlet 16 and provides buoyancy to the chamber 60 which is rapidly moved upward, indicated by the arrow 66 by the inrush of water indicated by the arrows 30.

Thus, the valve 36 hydraulically assists the opening upward movement of the float body 26 and since less force is required to open the valve 36 than the float body 26, the required exterior operational force to operate the float body 26 is significantly reduced. Upon upward movement of the float body 26, a lower flapper seal 68 is separated from a discharge body portion 72 of the housing 12.

With specific reference to FIG. 3, the mechanism 10 further includes a flow control chamber 76 which communicates with the upper flush valve chamber 60 through at least one hole 80.

Access to the flow control chamber 76 is provided through a slide mechanism 84 which includes an adjustable port 86 for controlling water flow into the flow control chamber 76 and through the hole. Movement of the slide mechanism indicated by the arrow 88, positions a slider door 90 to adjust the port 86 size. Water flow through the hole 80 from the flow control chamber 76 and through the port 86 controls downward movement of the float body 26 which in turn stops discharge water through the tank outlet.

Again, with specific reference to FIG. 3, a cover 92 and buoyant counterweight 96 are disposed in the flow control chamber 76 with the counterweight 96 connected to the cover. A lever 100 is pivotable about a pin 102 in order that the hole 80 is open when the counterweight 96 is in a downward position, as shown in bold line in FIG. 3, and closed when the counterweight is in an upper position, shown in dashed line in FIG. 3. The counterweight 96 moves to the downward position upon loss of buoyancy when water is drained from the flow control chamber 76 through the upper flush valve chamber 60.

A spring 104 is provided for both biasing the seat 44 against the seal 56 and further assisting the upward movement of the float body 26 and flush valve chamber 60.

Although there has been hereinabove described a specific improved flush valve for water closets in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A flush mechanism for a water closet, said flush mechanism comprising:

a housing fixable to a toilet flush tank outlet;

a float body, movable within said housing, for controlling water discharge though the tank outlet;

valve means, disposed in said float body, for hydraulically assisting upward opening movement of the float body thereby reducing exterior operational force required to operate the float body, said valve means comprises an upper flush valve chamber and a moveable seat releaseably engaging a float seal, for releasing water from the upper flush valve chamber and into the tank outlet, the upper flush valve chamber, the seat, and the seal rising with said float body in order to discharge water though the tank outlet;

a flow control chamber in fluid communication with said upper flush valve chamber though at least one hole;

a cover for sealing said hole, said cover being connected to a buoyant counterweight; and an adjustable slide mechanism for controlling water flow through the hole and into said upper flush valve chamber to control downward movement of said float body and stop discharge of water though the tank outlet.

2. The flush mechanism according to claim 1 further comprising a spring for both biasing the seat against the float seal and assisting upward movement of the float body.

3. The flush mechanism according to claim 2 wherein the seat is formed at an end of a moveable overflow tube, downward movement of the tube separating the seat for the float seal.

4. The flush mechanism according to claim 3 wherein said buoyant counterweight and cover are disposed in said flow control chamber with the counterweight connected to said cover for opening the cover over the hole when the counterweight is in a downward position and closing the cover when the counterweight is in an upward position, the counterweight moving to the downward position upon loss of buoyancy.

5. A flush mechanism for a water closet, said flush mechanism comprising:

a housing fixable to a toilet flush tank outlet;

a float body, movable within said housing, for controlling water discharge through the tank outlet;

a hydraulic assist valve, disposed in said float body and moveable therewith, for causing upward opening movement of the float body in order to reduce exterior operational force required to operate the float body, the valve comprises an upper flush valve chamber and a moveable seat releaseably engaging a float seal, for releasing water from the upper flush valve chamber and into the tank outlet, the upper flush valve chamber, the seat, and the seal rising with said float body in order to discharge water through the tank outlet;

a flow control chamber in fluid communication with said upper flush valve chamber through at least one hole;

a cover for sealing said hole, said cover being connected to a buoyant counterweight; and an adjustable slide mechanism for controlling water flow through the hole and into said upper flush valve chamber to control downward movement of said float body and stop discharge of water through the tank outlet.

6. The flush mechanism according to claim 5 further comprising a spring for both biasing the seat against the float seal and assisting upward movement of the float body.

7. The flush mechanism according to claim 6 wherein the seat is formed at an end of a moveable overflow tube, downward movement of the tube separating the seat for the float seal.

8. The flush mechanism according to claim 7 wherein said buoyant counterweight and cover are disposed in said flow control chamber with the counterweight connected to said cover for closing the cover over the hole when the counterweight is in a upward position and opening the cover when the counterweight is in an downward position, the counterweight moving to the downward position upon toss of buoyancy.

* * * * *